United States Patent [19]

Gray et al.

[11] Patent Number: 5,018,431

[45] Date of Patent: May 28, 1991

[54] APPARATUS FOR POSITIONING A WORK IMPLEMENT

[75] Inventors: Thomas J. Gray, Waukesha; Edwin O. Martinson, Milwaukee, both of Wis.

[73] Assignee: Quadrastat Corporation, City of Industry, Calif.

[21] Appl. No.: 282,482

[22] Filed: Dec. 9, 1988

[51] Int. Cl.[5] ..... F15B 9/03; F15B 9/09

[52] U.S. Cl. ..... 91/363 R; 91/459; 91/361; 137/625.64; 137/596.17

[58] Field of Search ..... 91/361, 459, 419, 461, 91/363 R, 362, 304, 305, 48, 51; 251/129.05, 129.08, 129.11, 129.14; 137/625.64, 596.17

[56] References Cited

U.S. PATENT DOCUMENTS

| | | | |
|---|---|---|---|
| 3,434,390 | 3/1969 | Weiss | 137/625.64 |
| 3,736,958 | 6/1973 | Rostad . | |
| 3,771,565 | 11/1973 | Padula . | |
| 3,777,784 | 12/1973 | Nicholson . | |
| 3,874,405 | 4/1975 | Thayer . | |
| 4,046,165 | 9/1977 | Rose, Sr. et al. . | |
| 4,313,465 | 2/1982 | Holzem et al. | 251/129.05 |
| 4,391,292 | 7/1983 | Millar | 137/596.17 |
| 4,428,400 | 1/1984 | Tantardini | 137/625.64 |
| 4,513,782 | 4/1985 | Contartese et al. | 91/363 R |
| 4,534,382 | 8/1985 | Tanguy | 137/596.17 |
| 4,570,904 | 2/1986 | Mullally | 251/129.01 |
| 4,574,686 | 3/1986 | Budzich | 91/361 |
| 4,580,598 | 4/1986 | Itoh | 137/596.17 |
| 4,595,035 | 6/1986 | Warrick | 251/129.14 |
| 4,610,267 | 9/1986 | Beck et al. | 251/129.14 |
| 4,625,622 | 12/1986 | Gunda et al. | 91/361 |
| 4,671,166 | 6/1987 | Glaze et al. | 91/361 |
| 4,674,536 | 6/1987 | Warrick | 251/129.14 |
| 4,688,468 | 8/1987 | Axinti et al. | 91/433 |
| 4,714,005 | 12/1987 | Leemhuis | 91/361 |
| 4,757,747 | 7/1988 | Blatter et al. | 91/362 |
| 4,766,921 | 8/1988 | Williams | 251/129.05 |
| 4,773,302 | 9/1988 | Mizota et al. | 91/361 |
| 4,778,147 | 10/1988 | Kozuka et al. | 251/129.08 |
| 4,796,855 | 1/1989 | Sofianek | 251/129.15 |
| 4,799,420 | 1/1989 | Budzich | 91/461 |
| 4,805,515 | 2/1989 | Kast | 91/461 |
| 4,813,443 | 3/1989 | Pounder | 251/129.08 |
| 4,817,499 | 4/1989 | Bellanger et al. | 91/361 |

FOREIGN PATENT DOCUMENTS

| | | | |
|---|---|---|---|
| 2929831 | 7/1979 | Fed. Rep. of Germany . | |
| 0086601 | 5/1982 | Japan | 91/361 |
| 0103913 | 6/1982 | Japan | 91/361 |
| 0068504 | 4/1983 | Japan | 91/361 |
| 0200874 | 11/1983 | Japan | 251/129.05 |
| 2082799 | 3/1982 | United Kingdom | 91/361 |
| 2103390 | 2/1983 | United Kingdom | 137/625.64 |

*Primary Examiner*—Edward K. Look
*Assistant Examiner*—Thomas Denion
*Attorney, Agent, or Firm*—Michael, Best & Friedrich

[57] ABSTRACT

An apparatus for positioning a work implement in predetermined operative attitudes, including a valve body mounting a piston which is operable for movement through a range of selective operative positions, and which is further connected to the work implement; a pair of pulse valves mounted on the valve body and connected in fluid communication with the piston and operable selectively to supply a source of hydraulic pressure to the valve body; and an actuator is connected in signal transmitting relation to the pair of pulse valves and is adapted selectively to actuate same thereby causing the selective release of hydraulic pressure to position the piston, and thus the work implement in a selected operable attitude.

29 Claims, 3 Drawing Sheets

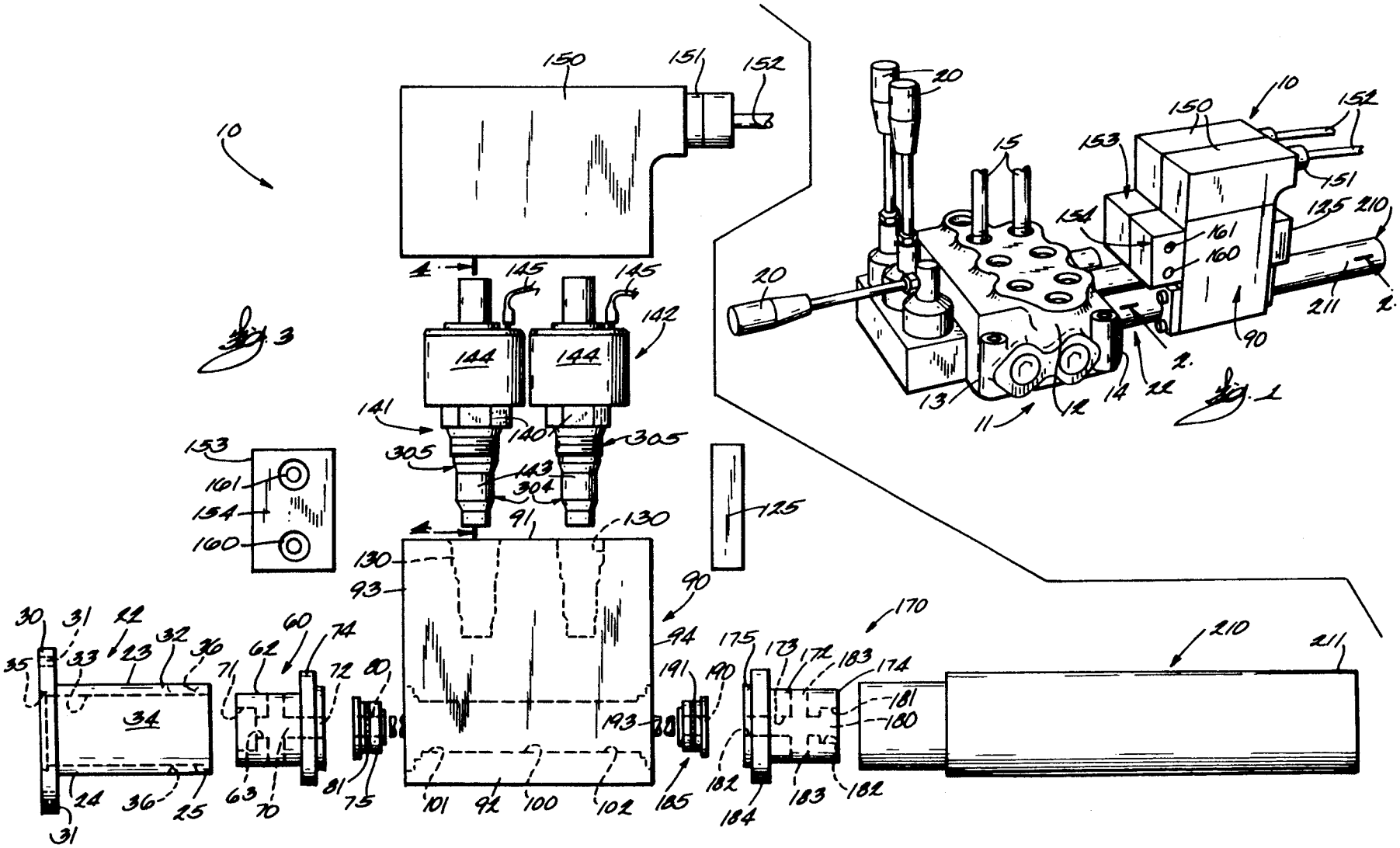

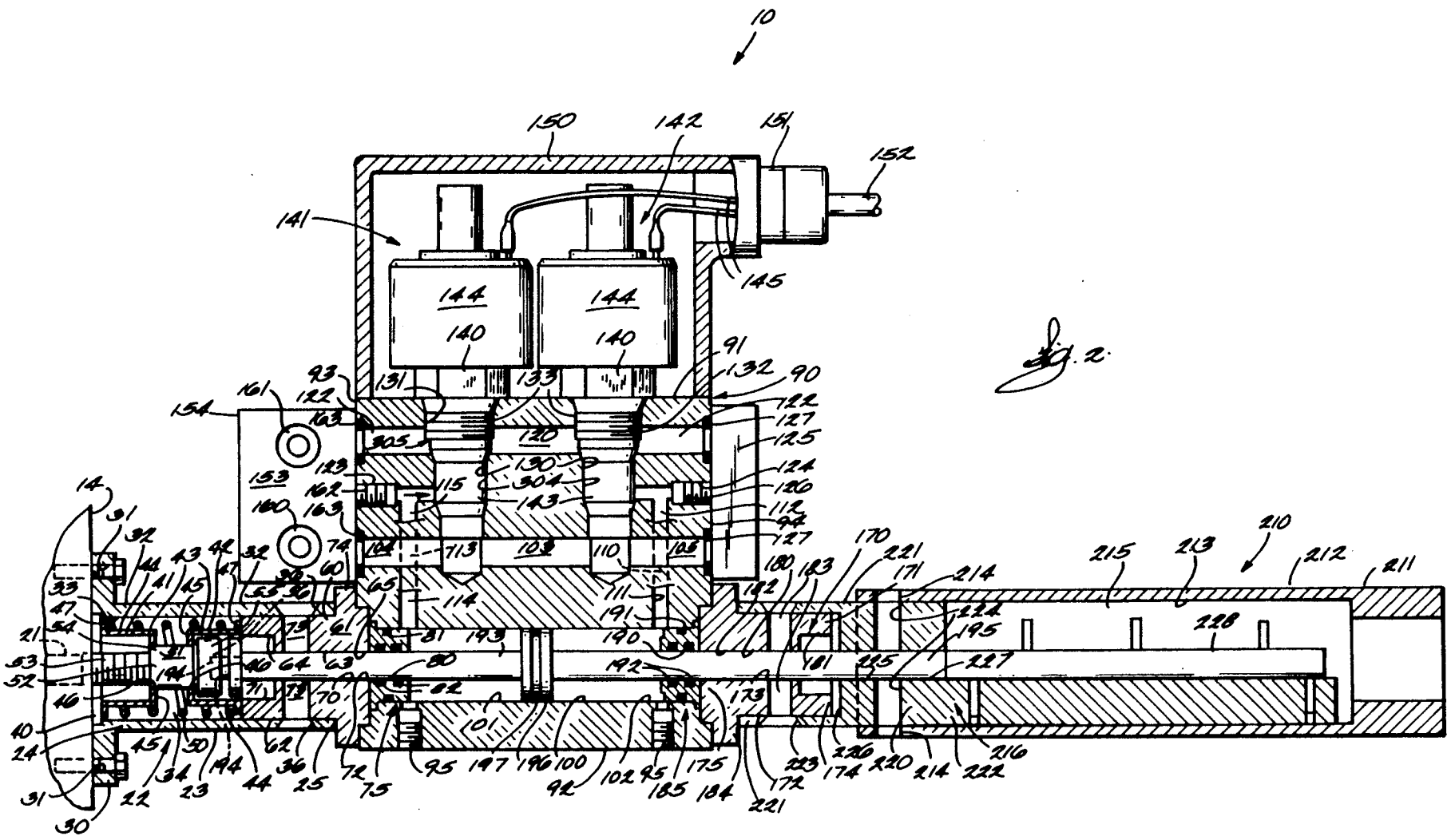

APPARATUS FOR POSITIONING A WORK IMPLEMENT

BACKGROUND OF THE INVENTION

1. Field of the Invention

The present invention relates to an apparatus for positioning a work implement in predetermined operative attitudes and more particularly to a remotely controllable actuator which has utility when employed to position variously designed spool valve assemblies of a hydraulic valve in selected operative positions relative to a predetermined path of travel thereby permitting the selective release of a source of fluid under pressure to accomPlish assorted tasks, the actuator imparting improved performance characteristic to a hydraulic valve which is so actuated.

2. Description of the Prior Art

The beneficial effects of employing remotely controllable devices for the performance of assorted tasks have been known for some time. Such devices, heretofore, typically have been utilized to perform various dangerous or undesirable operations. More recently, research has been conducted on the remote actuation of assorted valve assemblies such as those valve assemblies utilized to control the selective release of hydraulic fluid under pressure. Heretofore, the remote metering of various fluids have been accomplished by assorted solenoid valve assemblies. Such a remotely controllable solenoid valve assembly is disclosed in U.S. Pat. No. 4,610,267 to Beck et al. and which relates to a fast response solenoid valve assembly. While remotely controllable valves of various designs have operated with varying degrees of success, they commonly possess shortcomings which have detracted from their usefulness. For example, prior art remote control actuators have not been capable of providing accurate control of the force applied to a valve spool nor accurate control of the rate of movement of the valve spool.

While the prior art is replete with numerous examples of remotely controllable devices which have been developed for particular applications and environments, they each suffer, however, from readily apparent drawbacks which have detracted from their utilization except in combination with particular devices. For example, such devices have typically been quite cumbersome to utilize or alternatively have had physical dimensions which impead the utilization of the apparatus so equipped. Further, manufacturers who produce remotely controllable devices for various machines must, as a general matter, manufacture assorted differently designed parts in order to assemble these individual devices, with the costs attendant to such design and manufacture. Moreover, these various devices have individually unique maintenance and supply problems which are peculiar to the individual devices under consideration.

Still another significant problem with the prior art devices and practices results from characteristics inherent in their individual designs. For example, where conversion or retrofit is required with such devices, they must either be converted at a remote field location or returned to a manufacturer for such conversion. Neither approach has proven satisfactory, in the first instance because of lack of reliability when installed at remote field locations, and in the second instance, because of the expenses attendant to returning such devices to the manufacturer. In addition, the initial cost of manufacturing and installing the device, as well as the overall maintenance cost requirements related to these devices may be substantial in some instances.

Therefore, it has long been known that it would be desirable to have a remotely operable actuator for positioning a work implement and which has particular utility when utilized to position a conventionally designed spool valve assembly, the apparatus operable to position the spool valve assembly precisely and with a high degree of reliability, the apparatus being of compact configuration and remotely operable to actuate the spool valve assembly of assorted differently designed devices with the attendant benefits to be derived from such remote operation.

SUMMARY OF THE INVENTION

Therefore, it is an object of the present invention to provide an improved actuator for positioning a work implement.

Another object is to provide such an actuator which facilitates the movement of the work implement through a range of selected operative positions along a predetermined path of travel.

Another object is to provide such an actuator which has particular utility in facilitating the movement of a spool valve assembly into predetermined operative positions.

Another object is to provide such an actuator which can be readily retrofitted with little or no difficulty to existing valve assemblies or can alternatively be manufactured as an integral subassembly thereof.

Another object is to provide such an actuator which is operable to cooperate in combination with a conventionally designed spool valve assembly which is an integral component of another device, the apparatus facilitating the operation of the device in a remotely controllable fashion with the attendant benefits achieved from such operation.

Another object is to provide such an actuator which permits manual or remote operation of the apparatus by employing infrared, fiber optics, radio, computer, or air controlled actuation, thereby increasing the versatility of the apparatus.

Another object is to provide such an actuator which is characterized by simplicity of design, ease of employment, and which can be sold and maintained at a relatively nominal price.

Another object is to provide such an actuator which is operable to obtain the individual benefits to be derived from related prior art devices while avoiding the detriments individually associated therewith.

Further objects and advantages are to provide improved elements and arrangements thereof in an apparatus for the purposes described which is dependable, durable, and fully effective in accomplishing its intended purposes.

These and other objects and advantages are achieved in the actuator of the present invention wherein, in the preferred embodiment, the actuator includes an actuator body which houses a piston that is disposed in force transmitting relation relative to a valve spool, and which further mounts a pair of pulse valves which individually supply a predetermined volume of hydraulic fluid under pressure to the piston to cause the piston to be positioned in selected operative positions relative to the actuator body, the actuator imparting improved performance characteristics to the valve spool which is so actuated.

BRIEF DESCRIPTION OF THE DRAWINGS

FIG. 1 is a perspective side elevation of the apparatus of the subject invention shown in a typical operative environment wherein two of the inventions are shown mounted in side by side relation on a hydraulic valve of conventional design.

FIG. 2 is a longitudinal, vertical, sectional view of the apparatus of the subject invention taken from a position along line 2—2 of FIG. 1.

FIG. 3 is a fragmentary, exploded, side elevation of the apparatus of the subject invention with some underlying structures indicated in hidden lines.

DESCRIPTION OF THE PREFERRED EMBODIMENT

Figure 4:
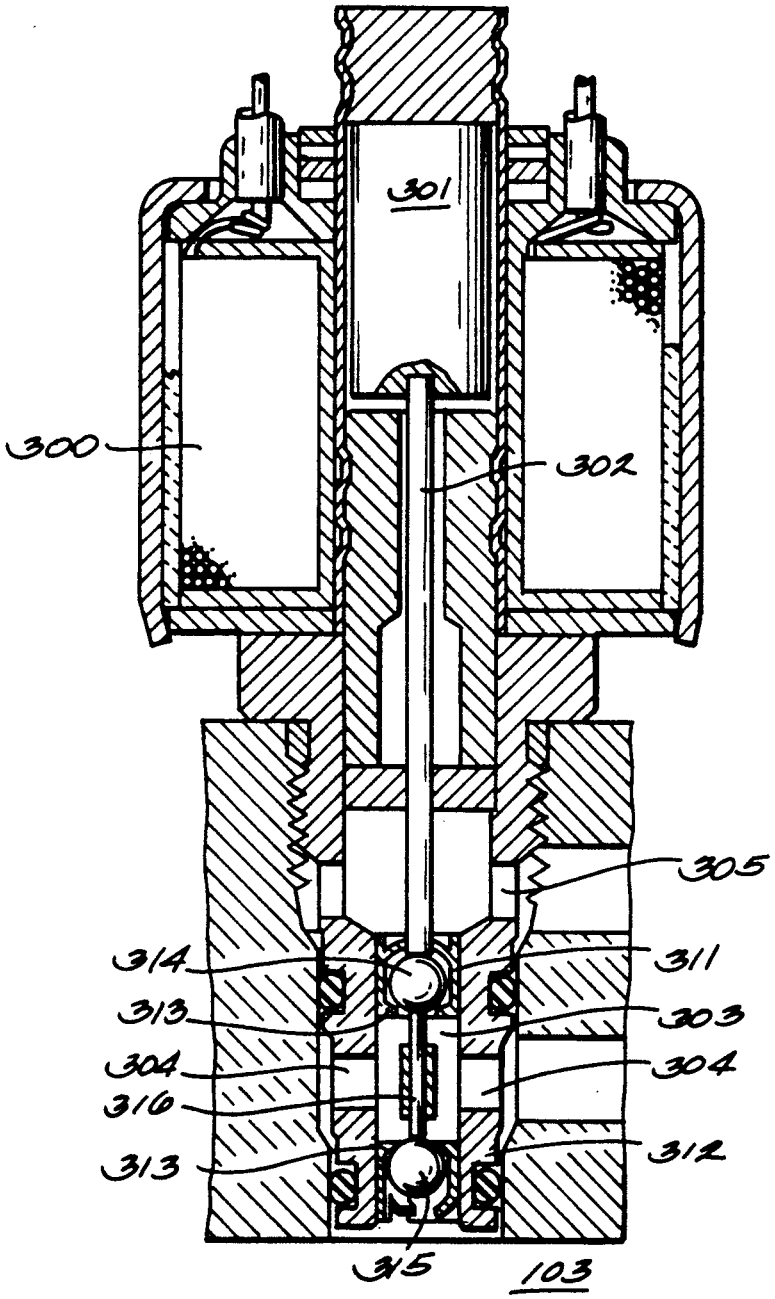
FIG. 4 is longitudinal, vertical, sectional view of the apparatus of the subject invention taken from a position along line 4—4 of FIG. 3.

Referring more particularly to the drawings, the actuator of the present invention is generally indicated by the numeral 10 in FIG. 1. For illustrative convenience, the actuator is shown and described as it would be configured if it were manufactured as an integral component, or later installed in the manner of a retrofit, on a valve which is generally indicated by the numeral 11. However, it should be readily recognized that the actuator of the subject invention can be employed on a variety of assorted devices which have one or more work implements that must be adjusted from one position to another relative to a work surface or alternatively with respect to a predetermined path of travel to accomplish various objectives.

As shown in the drawings, the actuator 10 is operable to be mounted on a conventionally designed hydraulic valve which is generally indicated by the numeral 11. The hydraulic valve has a main body 12 with a proximal end 13 and a distal end 14 which is remote thereto. A plurality of hydraulic lines 15 are mounted in fluid communication with the main body. As best seen by reference to FIG. 1 the main body 12 supports on its proximal end a plurality of handles 20 which are operable to actuate the hydraulic valve thereby selectively releasing a source of hydraulic fluid (not shown) under pressure into the individual hydraulic lines 15. The hydraulic valve further includes a valve spool 21, only a portion of which is shown, and which is operable slideably to be moved internally of the main body 12 thereby causing the selective release of the hydraulic fluid under pressure into a selected one of the plurality of hydraulic lines in a manner well understood by those skilled in the art. The valve spool is also of conventional design, and is mounted on the main body and disposed in predetermined attitudes relative to the main body by utilizing biasing springs, not shown.

Means are provided for mounting the actuators 10 onto the main body 12 such that each actuator can be connected in force transmitting relation to the valve spool 21. Those skilled in the art will readily recognize that various means could be provided for mounting the actuator on the main body. The illustrated arrangement is therefore a preferred example but is not the only means by which such could be accomplished. The apparatus 10 includes a frame member or flange adaptor generally indicated by the numeral 22 and which is affixed, using conventional fasteners, on the distal end 14 of the hydraulic valve 11. The flange adaptor has a substantially cylindrical main body 23 with a first end 24 and a second end 25. As best illustrated by reference to FIG. 2 the flange adaptor mounts a flange member generally indicated by the numeral 30 and which is disposed in a substantially normal attitude relative to the main body. The flange member has formed therein a plurality of orifices which are individually operable slideably to receive suitable fasteners which individually secure the flange adaptor to the main body 12 of the hydraulic valve 11. Further, and as best illustrated by reference to FIG. 3, the flange adaptor has an outside surface 32, and an opposed inside surface 33 which defines a substantially longitudinally disposed passageway 34. Further, a substantially concentric recessed area 35 is formed into the flange member 30 at the first end 24 of the main body 25.

As best illustrated by reference to FIG. 2, a spring hat washer 40 conformably is dimensioned for mating receipt in the recessed area 35 which is disposed at the first end 24 of the frame 22. The washer 40 has a substantially centrally disposed orifice, not shown, which communicates with the passageway 34. Further, the frame 22 includes first and second spring hats which are generally indicated by the numerals 41 and 42 respectively. Each spring hat includes a substantially cylindrical sidewall 43 of substantially identical dimensions. Each spring hat also has an outside surface 44; and an end wall 45, is mounted on the cylindrical sidewall, and is disposed in a substantially normal attitude thereto. As best illustrated by reference to FIG. 2, a substantially longitudinally disposed orifice 46 is formed in each of the end walls 45, and each of the spring hats further include a flange or base member 47 which is mounted on the substantially cylindrical sidewall 43. As best seen by reference to FIG. 2, and when the pair of spring hats are slideably disposed in a proper attitude internally of the passageway 34, the individual spring hats are operable to position the pair of orifices 36 in substantially coaxial alignment. The significance of this feature will be discussed in greater detail hereinafter.

A biasing spring 50 is disposed in slideable mating receipt in the passageway 34 which is defined by the frame member 22. It should be understood that the biasing spring is received about each of the spring hats and is operable to urge the first and second spring hats apart. This relationship is best seen by reference to FIG. 2. The frame member 22 includes a spool engagement member which is generally indicated by the numeral 51, and which further has a main body 52, a threaded first end 53 and a second end 54. A head 55 is mounted on the second end 54 and has formed therein a depression 56 of predetermined dimensions. Slideably mounted in mating receipt on the second end 25 of the frame member 22 is a first gland assembly which is generally indicated by the numeral 60. The first gland assembly has a main body 61 of substantially uniform dimension and which is operable substantially slideably to be received in mating relation in the passageway 34. Further, the first gland assembly has an outside surface 62, an opposed inside surface 63, a first end 64 and a second end 65. The inside surface 63 defines a substantially longitudinally disposed passageway 70 that has a first portion 71, and a second portion 72 of substantially reduced dimension. Further, the first gland assembly has a pair of substantially transversely disposed passageways 73 formed therein which, when the first gland assembly is disposed in sliding mating receipt on the second end of the frame member, thereby positions the pair of transversely disposed passageways in substantial registry and coaxial alignment with the pair of orifices 36 which are formed in the main body 23 of the frame member. As should be understood, a suitable fastener is operable to be received in the orifices and passageways which are so aligned thereby permitting the first gland assembly 60 to be secured in fixed relation on the frame member.

A flange member which is generally indicated by the numeral 74, is disposed in a substantially normal attitude relative to the outside surface 62 of the main body 61 and further is operable to engage the outside or external surface of the actuator body which will hereinafter be discussed in greater detail. The flange member has a plurality of orifices, not shown, which are formed therein and which are individually adapted to receive a suitable fastener which are individually adapted to engage the actuator body thereunder. In this fashion the frame member is mounted on the actuator body. A sealing member 75 is mounted on the second end 65 of the first gland assembly 60 and further has formed therein a longitudinally disposed passageway 80 which is disposed in registry and in substantially coaxial alignment with the passageway 70 which is defined by the first gland assembly. Further, the sealing member mounts an outwardly disposed gasket 81 which is disposed in fluid sealing relation against the actuator body. Further, a pair of inwardly disposed gaskets 82 are mounted in substantially fluid sealing relation relative to the longitudinally disposed passageway 80. The significance of this feature will hereinafter be discussed in greater detail.

The actuator body which is generally indicated by the numeral 90 is mounted on the frame member 22 by a plurality of fasteners not shown. The actuator body 90 has top and bottom surfaces 91 and 92 respectively, and forwardly and rearwardly facing sidewalls 93 and 94 respectively. As best seen by reference to FIG. 2 a pair of orifices 95 are formed in the bottom surface. Further, a cylindrically shaped channel hereinafter referred to as the cylinder 100, is formed in the actuator body 90, and is disposed in substantially coaxial alignment with the passageway 34 which is defined by the frame member 22. The cylinder has a first end 101, and a second end 102. Further, a fluid intake or first fluid channel 103 is formed in the actuator body and similarly has a first end 104 and a second end 105. As best illustrated by reference to FIG. 2, a second fluid channel 110 is disposed in fluid communication between the second end 102 of the cylinder, and with a valve conduit which will hereinafter be discussed in greater detail. The second fluid channel has a first end 111, and an opposed second end 112. Further, a third fluid channel 113 is formed in the actuator body and similarly has a first end 114, and an opposed second end 115. The third fluid channel, like the second fluid channel, is disposed in fluid communication between the first end of the cylinder and another valve conduit which will hereinafter be discussed in greater detail. A fluid exhaust channel which is generally indicated by the numeral 120 has a first end 121 and a second end 122. Formed substantially centrally of the forwardly facing and rearwardly facing surfaces, 93 and 94 respectively are individual first and second threaded channels 123 and 124 respectively. As best illustrated by reference to FIG. 2, an end cap which is generally indicated by the numeral 125 is mounted on the actuator body by a fastener 126 which is operable screwthreadably to be received in the second threaded channel 124. The end cap mounts on its inwardly facing surface a pair of seals which are generally indicated by the numeral 127 and which sealingly engage the actuator body. The pair of seals are disposed in fluid impeding relation relative to the first fluid channel and the fluid exhaust channel respectively. This relationship is clearly shown by reference to FIG. 2.

As should be understood, a pair of valve conduits 130 individually are formed in the actuator body 90 and are disposed in fluid communication with the first, second and third fluid channels 103, 110 and 113 respectively, as well as the fluid exhaust channel 120. The pair of valve conduits includes a first valve conduit 131 and a second valve conduit 132. Each of the valve conduits has a threaded portion 133. Further, each valve conduit is substantially identically dimensioned and is operable screwthreadably to receive individual pulse valves which will hereinafter be described in greater detail.

A pair of three-way pulse width modulated pulse valves are generally indicated by the numeral 140, and are most clearly illustrated by reference to FIGS. 2 and 4. The pair of pulse valves include a first pulse valve 141, and a second pulse valve 142. Each of the pulse valves have a valve portion 143 which is matingly received in the individual first and second valve conduits 131 and 132 respectively, and further have individual solenoid portions 144 which are mounted thereon. A suitable electrical lead 145 is mounted on each of the solenoid portions 144. A housing which is generally indicated by the numeral 150 encloses the pair of pulse valves 140 and an electrical connector 151 is affixed to the housing and is electrically connected with the pair of electrical leads 145. A detachable electrical lead 152 is operable matingly to interconnect with the electrical connector 151 and further is operable to be electrically connected in signal transmitting relation with a suitable programmable actuating means such as a microprocessor or solenoid driver (not shown). Alternatively the apparatus may be actuated by devices which utilize infrared; fiberoptics; or radio control; as environmental or other conditions may require.

A suitable microprocessor or solenoid driver for actuating the individual pulse valves can be purchased from readily available commercial sources. A commercially acceptable microprocessor, Model SBC-10, is available from Hydro-Electronic Devices of Hartford, WI, and a suitable solenoid driver model SD-1 is commercially available from BKM Inc. of San Diego, CA.

The three-way pulse width modulated valves 140 which are included in the apparatus embodying the present invention are best understood by a study, FIG. 4. As shown therein, the individual solenoid portions include a coil 300 which is electrically connected to the electrical leads 145, and a plunger 301 is responsive, upon energizing the coil to move downwardly in proportional response to the level of energization. The plunger supports a plunger pin 302 which is disposed for substantially coaxial movement along the longitudinal axis of the valve portion 143. The valve portion defines a bore 303, and substantially radial extending passageways 304 and 305 individually are formed in the valve portion and are disposed in fluid communication with the second, and third fluid channels 103 and 110 and the fluid exhaust channel 120, as appropriate. These relationships are best seen by reference to FIG. 2. The valve portion further includes first and second ball cages 311, and 312 which individually are disposed in predetermined positions along the bore. Each ball cage defines a seat 333, and further individually encloses first and second balls 314 and 315 respectively. The valve portion further supports, for slideable movement between the balls, a separator pin 316.

As should be understood, when the coil 300 is energized, the plunger 301 is urged downwardly, as that is viewed in FIG. 4, thereby causing the plunger pin 302 to urge the first ball 314 downwardly toward the seat 313 of the first ball cage 311. As this movement begins the separator pin 316 is urged downwardly by the first ball thereby causing the second ball to be urged away from its occluding relationship with respect to the bore 303, the second ball held in the occluding position against the seat 313 by the hydraulic fluid under pressure which is supplied to the individual pulse valves through the first fluid channel 103. As the hydraulic fluid from the first fluid channel escapes into the bore it initially travels along the bore, past the second ball cage, and escapes through the radial passageway 305 and into the fluid exhaust channel 120. However, as the movement of the plunger continues, the second ball quickly is moved into occluding relation with the bore 303 when it is urged against the seat 313 of the first ball cage. When this event occurs, the hydraulic fluid, under pressure, travels into the radial passageway 304 where it is diverted into the cylinder 100 of the actuator body 90. When the coil is deenergized the plunger moves upwardly thereby permitting the second ball 315 to occlude the bore 303 thus preventing any further hydraulic fluid from entering the pulse valve and allowing the first ball 314 to move away from the seat 313 of the first ball cage 311. When this event occurs hydraulic pressure is allowed to escape from the cylinder 100 and travel through the radial passageway 304 and enter into the bore 303. Upon entering the bore the hydraulic fluid can escape past the second ball cage and be received into the fluid exhaust channel 120.

As should be understood, each of the pulse valves has a duty cycle. The duty cycle is defined as that period of time during which the coils 300 are energized during one cycle of operation. During the duty cycle, the pins 302 and 316 are moved to a position such that they unseat the second ball 315. In the preferred embodiment the individual pulse valves cycle at a substantially fixed frequency of approximately 40 cycles per second, although this could be adjusted upwardly in a range of approximately 40–80 cycles per second. By varying the duty cycle the inventors have discovered that they can control the hydraulic fluid pressure. More particularly, the inventors have discovered that adjustment of the duty cycle directly effects the hydraulic fluid pressure sensed by the piston. For example, an increase in the duty cycle increases the hydraulic pressure sensed by the piston in an amount equal to the root mean square of the varying pressure sensed at the radial passageway 304. Further, an adjustment of the frequency directly effects the volume of hydraulic fluid supplied to the cylinder. By substantially simultaneously activating each of the pulse valves 141 and 142 and thereafter individually adjusting them as to frequency and duty cycle as appropriate, the inventors have discovered that they can selectively move a piston to predetermined positions along the cylinder. The piston will hereinafter be discussed in greater detail.

A manifold, which is generally indicated by the numeral 153, has a main body 154 which includes an intake port 160 and an exhaust port 161. The intake port 160 is connected in fluid communication with the first end 104 of the first fluid channel 103, and the exhaust port 161 is disposed in fluid communication with the fluid exhaust channel 120. A threaded post or other suitable fastener which is generally indicated by the numeral 162 securely mounts the manifold on the main body 154 by being screwthreadably received into the first channel 123 that is formed in the actuator body 90. A pair of seals are indicated by the numeral 163, and are individually operable to be disposed in fluid sealing relation therebetween the main body 154 of the manifold 153, and the actuator body 90, thereby preventing leakage of hydraulic fluid between these adjoining surfaces. Further, it should be understood that a suitable source of hydraulic fluid under pressure, not shown, is connected in fluid communication with the intake port 160, and a suitable receiving tank, not shown, is mounted in fluid communication with the exhaust port.

As best illustrated by reference to FIGS. 2 and 3, a second gland assembly 170 is mounted on the actuator body 90 and disposed in substantially fluid impeding relation relative to the cylinder 100. The gland assembly 170 is substantially identical to the first gland assembly 60, that is, it has a main body 171 which includes an outside surface 172 and an opposed inside surface 173. Further, it has a first end 174 and a second end 175. Formed substantially centrally of the second gland assembly 170 is a substantially longitudinally disposed passageway 180 which is positioned in substantially coaxial alignment with the cylinder 100. Further, the passageway 180 is also disposed in substantially coaxial alignment with the passageway 70 which is formed in the first gland assembly 60. The longitudinally disposed passageway 180 has a first portion 181 and a reduced diameter second portion 182. Further, a pair of substantially transversely disposed passageways 183 are formed in the main body 171 and are adapted to receive a suitable fastener, not shown. A flange member 184 is mounted on the main body and is disposed in a substantially normal attitude thereto. The flange member is secured on the actuator body 90 by using suitable fasteners not shown. A sealing member 185 is mounted on the second end 175 of the main body and includes a longitudinally disposed passageway 190 which is disposed in substantially coaxial alignment with the passageway 180. As best illustrated by reference to FIG. 3, the sealing member includes an outwardly disposed gasket or seal 191 which is positioned in fluid sealing relation relative to the cylinder portion 100 and the sealing member 185. Further, the sealing member mounts a pair of inwardly disposed gaskets or seals 192 which are operable sealingly to engage an elongated piston rod which is generally indicated by the numeral 193. The piston rod has a first end of reduced dimension, 194, which is slideably received in the depression 56 which is formed in the head 55 of the spool engagement member 51, and a second end 195. It should be understood, therefore, that movement of piston rod along a path of travel which is disposed substantially longitudinally of the actuator body has the effect of urging the spool engagement member along a substantially similar longitudinal path of travel. The piston rod sealingly is received for slideable movement with the first and second gland assemblies 60 and 170 respectively. A piston which is generally indicated by the numeral 196, releasably is mounted on the piston rod by using a crimping technique at a predetermined location intermediate the first and second end. This feature is important inasmuch as it permits a uniform finish to be applied to the rod, and further permits an operator not shown, to move the piston rod in the event contamination or other malfunction causes the piston to become jammed in the cylinder 100. The piston mounts a seal or piston ring 197 which is disposed in substantially fluid sealing relation therebetween the piston and the cylinder portion.

A linear resistor element 210 is shown mounted on the valve body 90 and is operable to sense the relative position of the piston rod 193 and send a signal to the microprocessor, not shown. The linear resistor element is of conventional design and is commercially available from Maurey Instrument Corporation of Chicago, IL. For the sake of brevity, therefore, the linear resistor element is not discussed in significant detail herein. A housing which is generally indicated by the numeral 211 encloses the linear resistor element, the housing having an outside surface 212 and an opposed inside surface 213. Further, the housing has formed therein, a pair of orifices 214, and the inside surface 213 defines a space 215 of predetermined dimensions. The space 215 slideably receives a mounting sleeve 216 which is mounted on the second gland assembly 70. The mounting sleeve has a main body generally indicated by the numeral 220 and has a first end 221 and a second end 222. As best illustrated by reference to FIG. 2, a pair of orifices 223 are formed in the first end 221 and are thereby individually disposed in registry, and in substantial coaxial alignment with the pair of transversely disposed passageways 183. These passageways individually permit a fastener to be received therein thereby permitting the two subassemblies to be fastened together. Further, a pair of transversely disposed channels 224 are individually formed in the second end 222 and are thereby disposed in substantially coaxial alignment with the pair of orifices 214. In similar fashion a suitable fastener, not shown, can be received in these passageways thereby securing the housing on the mounting sleeve. Formed substantially centrally and longitudinally of the main body 220 is a longitudinally disposed channel 225. The channel 225 has a first portion 226 which slideably receives a portion of the main body of the second gland assembly, and a second portion 227 of substantially reduced dimension. As best seen by reference to FIG. 2, the channel 225 is disposed in substantially coaxial alignment with the cylinder 100. A sensing element 228 is mounted in the housing 211 and is operable to determine the relative position of the piston rod 193 and thereby provide a signal to the microprocessor.

OPERATION

The operation of the described embodiment of the present invention is believed to be readily apparent as briefly summarized at this point.

As best illustrated by reference to FIG. 2, the actuator 10 is operable to be mounted on a conventional hydraulic valve 11 which has a main body 12; the subject invention adapted to be manufactured as an integral component of a hydraulic valve 11 or alternatively mounted on the hydraulic valve 11 in the manner of a retrofit. The actuator 10 is operable to position a work implement in a predetermined operative attitude, the work implement in this instance, being a valve spool 21 of conventional design. As earlier discussed, the movement of the valve spool has the effect of diverting hydraulic fluid under pressure into the assorted hydraulic lines 15 to accomplish various tasks.

The actuator 10 has an actuator body 90 which has formed therein a cylinder 100 and first, second, and third fluid channels, and a fluid exhaust channel which are generally indicated by the numerals 103, 110, 113 and 120 respectively. A source of hydraulic fluid under pressure is mounted in fluid communication with the first fluid channel; and first and second pulse valves 141 and 142 are mounted in fluid communication with the first, second, and third fluid channels, as well as the fluid exhaust channel, and the cylinder. More particularly, the first pulse valve selectively is operable to connect in fluid communication the first fluid channel and the second fluid channel with the cylinder, and the cylinder, with the fluid exhaust channel. For example, the first pulse valve is operable to release hydraulic fluid, under pressure, from the first fluid channel and allow it to pass into the second fluid channel whereby it is received in the cylinder. When received in the cylinder, the piston 196 is operable to be urged along the cylinder thereby moving the piston rod 193 and simultaneously transmitting force to the spool engagement member 51. This in turn has the effect of urging the valve spool 21 along a substantially longitudinal path of travel thereby permitting the release of hydraulic fluid into the hydraulic lines 15. Moreover, the second pulse valve is mounted on the actuator body and disposed in fluid communication with the first fluid channel, the third fluid channel, and the fluid exhaust channel, as well as with the cylinder. The second pulse valve selectively is operable to connect, in fluid communication, the first and third fluid channels with the cylinder, and the cylinder with the fluid exhaust channel. Similarly, the second pulse valve is operable selectively to release hydraulic fluid from the first fluid channel and divert it into the third channel thereby allowing it to be received in the cylinder. Hydraulic fluid pressure so received in the cylinder, of course, has the effect of urging the piston and its associated piston rod along the cylinder, thereby allowing the spool engagement member 51 to move into an alternative position. As earlier discussed, the actuating means causes the individual three-way pulse valves to be actuated substantially simultaneous. This of course has the effect of releasing hydraulic pressure to both sides of the piston. This release of hydraulic fluid under pressure to both sides of the piston inhibits to some degree the oscillation of the piston. Each of the pulse valves, of course, are operable to release varying amounts of hydraulic fluid under pressure to both sides of the piston thereby permitting the piston to apply various amounts of pressure to the valve spool. The amount of pressure sensed by the piston is substantially controlled by selectively adjusting the duty cycle, and the cycling frequency of the individual pulse valves.

The pulse valves 140 individually are operable to release hydraulic fluid under pressure from the cylinder 100 and permit it to pass along the second and third fluid channels 110 and 113 respectively, and be received in the fluid exhaust channel 120. In this fashion the pulse valves are adapted to permit hydraulic pressure to be released from the cylinder portion 100 thereby permitting controlled substantially reciprocal longitudinal movement of the piston. As earlier discussed, the piston rod 193 is mounted for slideable movement relative to a linear resistor element 210 of conventional design, and which is operable to provide a signal regarding the relative position of the piston rod with respect to the sensing element 228. Further, hydraulic pressure sensors, not shown, individually are mounted in fluid communication in the pair of orifices 95 and are operable to provide a signal regarding the hydraulic pressure resident in the cylinder. The individual pulse valves 140 can be actuated remotely by assorted actuator means which may include fiber optics, radio, and microprocessor. In this fashion, the hydraulic valve 11 can be remotely actuated thereby permitting a work implement to be operated in remote areas with a high degree of accuracy and efficiency.

Therefore, it will be seen that the actuator of the instant invention is adapted to enhance the efficiency, speed, and accuracy with which a spool valve assembly can be remotely operated; and provides a fully dependable and practical means by which individual spool valve assemblies of conventional design can be retrofitted for remote operation with the attendant benefits associated therewith; the apparatus being of both sturdy and dependable construction and being relatively inexpensive to manufacture and maintain.

Although the invention has been herein shown and described in what is conceived to be the most practical and preferred embodiment, it is recognized that departures may be made therefrom within the scope of the invention which is not to be limited to the illustrative details disclosed.

Having described out invention, what we claim is new and desire to secure by Letters Patent is:

1. An actuator comprising:

an actuator body including a cylinder having opposite ends, a first fluid channel adapted to be connected to a source of hydraulic fluid pressure, and a second fluid channel individually connected in fluid communication to the cylinder;

a piston slideably housed in the cylinder and moveable through a range of selected operative positions;

a first pulse valve disposed in fluid communication between the first and second fluid channels for selectively controlling the supply of hydraulic fluid from the first fluid channel, through the second fluid channel and into the cylinder;

the actuator body having a fluid exhaust channel connected in fluid communication with the pulse valve, and the pulse valve being operable selectively to connect the second fluid channel and the fluid exhaust channel in fluid communication, a second pulse valve disposed in fluid communication with the actuator body, and the actuator body having a third channel connecting the second pulse valve and the cylinder in fluid communication, the second pulse valve selectively connecting the first and third fluid channels in fluid communication, and the third fluid channel and the fluid exhaust channel in fluid communication, and means for selectively actuating the first pulse valve and the second pulse valve for positioning the piston in a selected one of said operative positions, said means for selectively actuating the first and second pulse valves including control means connected in controlling relation with said pulse valves for reciprocating said pulse valves in N cycle per second modes, and for varying N to thereby control fluid pressure application to the piston.

2. The apparatus of claim 1 wherein the cylinder has a first and second end, and the first and third fluid channels individually are connected in fluid flow communication with the cylinder at the first and second ends respectively, and the actuator body includes means for connecting the piston in force transmitting relation with a work implement.

3. The apparatus of claim 2 wherein the connector means is a piston rod and the actuator body supports in sealing relation the piston rod for slideable movement, and the piston rod has opposite ends, the piston releasably affixed on the piston rod in a position intermediate its opposite ends.

4. The apparatus of claim 3 and further including means for sensing the relative position of the piston rod, and means for sensing the hydraulic pressure resident in the cylinder.

5. The apparatus of claim 4 wherein the actuating means is a microprocessor operably connected in signal transmitting relation with the first and second pulse valves, and with each sensing means, and the microprocessor is operable selectively to actuate each of the pulse valves substantially simultaneously thereby regulating the volume of hydraulic fluid and the hydraulic pressure supplied to the cylinder.

6. The apparatus of claim 5 wherein the piston is disposed intermediate the first and second ends of the cylinder, and the hydraulic pressure sensing means is operable to sense the hydraulic pressure resident at the first and second ends of the cylinder portion and provide a signal to the microprocessor.

7. The apparatus of claim 6 wherein the first and second pulse valves are affixed on the actuator body, and each comprise a 3-way pulse width modulated valve and wherein, the microprocessor includes means for controlling the duty cycles of the pulse valves to control the hydraulic fluid pressure supplied to the first and second ends of the cylinder.

8. The apparatus of claim 1 wherein the pulse valve comprises a three-way pulse width modulated valve.

9. An actuator adapted to be connected to a valve spool housed in a valve body, the actuator comprising:

an actuator body adapted to be supported by the valve body and having a cylinder, the actuator body including a first fluid channel connected in fluid communication with a source of hydraulic fluid under pressure, a second fluid channel connected in fluid communication with the cylinder and a fluid exhaust channel;

a three way pulse width modulated valve supported by the actuator body and disposed in fluid communication with the first fluid channel, second fluid channel and fluid exhaust channel, the three-way pulse width modulated valve being operable selectively to connect in fluid communication the first fluid channel, the second fluid channel and the fluid exhaust channel and to control supply of hydraulic fluid under pressure to the cylinder;

a piston slideably housed in the cylinder for movement through a range of selected operative positions;

a piston rod releasably affixed to the piston and interconnecting the piston and the valve spool; and means for selectively actuating the three-way pulse width modulated valve for positioning the piston in a selected one of said operative positions and thereby causing a corresponding movement of the valve spool, the means for selectively actuating the three-way pulse width modulated valve including control means connected in controlling relation with said pulse width modulated valve for reciprocating said pulse width modulated valve in N cycles per second modes, and for varying N to thereby control fluid pressure application to the piston.

10. The actuator of claim 9 wherein a means for sensing the relative position of the piston rod is borne by the actuator body and includes a linear resistor element, and the actuating means includes a microprocessor which is disposed in signal transmitting relation with each of the pulse valves, and the linear resistor element is connected in signal transmitting relation with the microprocessor.

11. An actuator adapted to be connected to a valve spool housed in a valve body, the actuator comprising;

an actuator body adapted to be mounted on the valve body and having a cylinder, a first, second, and third fluid channels, and a fluid exhaust channel, the first fluid channel connected in fluid communication with a source of hydraulic fluid under pressure;

a first pulse valve borne by the actuator body and disposed in fluid communication with the first fluid channel, second fluid channel, the fluid exhaust channel, and the cylinder, the first pulse valve selectively connecting in fluid communication the first fluid channel and the second fluid channel with the cylinder, and the cylinder with the exhaust channel;

a second pulse valve borne by the actuator body and disposed in fluid communication with the first fluid channel, the third fluid channel, the fluid exhaust channel and with the cylinder, the second pulse valve selectively connecting in fluid communication the first and third fluid channels with the cylinder, and the cylinder with the fluid exhaust channel;

a piston slideably housed in the cylinder for movement through a range of selected operative positions;

a piston rod releasably mounted on the piston and interconnecting the piston and the valve spool, the piston rod operable upon movement of the piston through the range of selective operative positions to cause corresponding movement of the valve spool;

means for selectively actuating the individual pulse valves for positioning the piston in a selected one of said operative positions, the actuating means causing the individual pulse valves selectively to supply a predetermined amount of hydraulic fluid and hydraulic pressure to the cylinder, the actuating means including control means connected in controlling relation with said pulse valves for reciprocating said pulse valves in N cycle per second modes, and for varying N to thereby control fluid pressure application to the cylinder; and means borne by the actuator body for sensing the hydraulic pressure, and the relative position of the piston rod, the sensor means mounted in signal transmitting relation relative to the control means for operation during movement of the piston into one of said operative positions.

12. The actuator of claim 11 wherein the cylinder has first and second ends, and the second and third fluid channels individually are disposed in fluid communication with the first and second ends of the cylinder portion respectively, and the piston is disposed intermediate the first and second ends.

13. The actuator of claim 12 wherein the first and second pulse valves individually control the volume and the pressure of the hydraulic fluid supplied to the first and second ends of the cylinder, and the actuating means is operable substantially simultaneously to actuate the first and second pulse valves.

14. The actuator of claim 13 wherein the actuating means is a microprocessor, and the pulse valves are adjustable three-way electro-hydraulic pulse width modulate pulse valves which have selectively adjustable duty cycles and which are individually responsive to a range of frequencies, and adjustment of the individual duty cycle causes each of the pulse valves to supply a predetermined hydraulic pressure to the cylinders, and adjustment of the frequency causes the individual pulse valves to supply a selected volume of hydraulic fluid to the cylinder, and the microprocessor is operable to adjust each of the pulse valves as to frequency and duty cycle.

15. The actuator of claim 14 wherein the hydraulic pressure sensing means is operable to detect the hydraulic pressure at the first and second ends of cylinder and supply a signal to the microprocessor, and the piston rod sensing means is a linear resistor element mounted on the actuator body and disposed in substantially coaxial alignment with the piston rod, the linear resistor element providing a signal to the microprocessor.

16. The actuator of claim 15 wherein the piston is releasably mounted on the piston rod, and the actuator body mounts a manifold which is disposed in fluid communication with the first fluid channel and the fluid exhaust channel.

17. In the method of operating a primary valve having a valve spool, movable to control fluid operation of a tool, the steps that include a) providing an actuator that includes an actuator body housing a piston disposed in force transmitting relation to the valve spool, b) providing a pair of electrically reciprocated fluid pulse width modulating valves having pressurized fluid pulse passing outlets, c) connecting said outlets to the actuator body to communicate with opposite sides of the piston, d) controllably electrically reciprocating said pulse valves to effect controlled communication of fluid pressure pulses from said pulse passing outlets to said opposite sides of the piston to thereby controllably and accurately displace the piston and said valve spool of said primary valve, e) said pulse valves also having exhaust fluid pressure outlets, and including the step of operating the pulse valves to connect said exhaust fluid outlets to the actuator body to controllably receive exhaust fluid from opposite sides of the piston, for controllably exhausting fluid from opposite sides of the piston in timed relation to said communication of fluid pressure pulses to the piston.

18. The method of claim 17 wherein the valves are operated in N cycles per second modes, and including the step of varying N to thereby control fluid pressure application to the piston.

19. The method of claim 18 wherein said step of varying N includes increasing N to thereby increase the fluid pressure exertion on the piston.

20. The method of claim 18 wherein said step of varying N also varies the volume of fluid supplied to said actuator body.

21. The method of claim 17 including connecting a microprocessor in controlling relation with said electrically reciprocated fluid pulse valves, and operating the microprocessor to control the pulse valves so as to effect said accurate movement of the piston and primary valve spool.

22. The method of claim 21 including sensing the position of the piston, and generating a feed-back signal corresponding to said sensing, and supplying said feed-back signal to the microprocessor, in controlling relation therewith.

23. A method for operating a primary valve having a valve spool, movable to control fluid operation of a tool, said method comprising a) providing an actuator that includes an actuator body housing a piston disposed in force transmitting relation to the valve spool, b) providing a pair of fluid pulse width modulating valves having respective fluid outlets and exhaust pressure outlets, c) connecting said fluid outlets and said exhaust pressure outlets to said actuator body to communicate with the opposite sides of said piston, and d) actuating said respective fluid pulse width modulating valves to supply fluid pressure pulses from said fluid outlets to said opposite sides of said piston to controllably displace the piston and said valve spool of said primary valve, and said respective fluid pulse width modulating valves controllably receiving through said exhaust pressure outlets exhaust fluid from opposite sides of said piston for controllably exhausting said exhaust fluid in timed relation to said pressurized pulse communication with the piston.

24. A method in accordance with claim 23 wherein the respective fluid pulse width modulating valves have a duty cycle and, the method further includes the step of varying said duty cycle of each fluid pulse width modulating valve thereby controlling fluid pressure application on said piston.

25. A method in accordance with claim 30 wherein said step of varying said duty cycle includes increasing said duty cycle thereby increasing the fluid pressure exertion on said piston.

26. A method in accordance with claim 30 wherein said step of varying said duty cycle also varies the volume of fluid supplied to said actuator body.

27. A method in accordance with claim 23 including the steps of connecting a microprocessor in signal transmitting relation relative to said respective fluid pulse width modulating valves and, operating said microprocessor to control the respective pulse width modulating valves so as to effect said accurate movement of said piston and said valve spool.

28. A method in accordance with claim 27 including the steps of sensing the position of said piston, generating a feed-back signal corresponding to said sensing, and supplying said feed-back signal to said microprocessor.

29. An apparatus for operating a primary valve having a valve spool, movable to control fluid operation of a tool, the combination comprising:

a) an actuator that includes an actuator body housing a piston disposed in force transmitting relation to the valve spool, b) a pair of fluid pulse width modulating valves having pressurized fluid pulse passing outlets, c) said outlets connected to the actuator body to communicate with opposite sides of the piston, d) solenoid means for controllably electrically reciprocating said pulse valves to effect controlled communication of fluid pressure pulses from said pulse valve outlets to said opposite sides of the piston to thereby controllably and accurately displace the piston and said primary valve, said pulse valves also having exhaust fluid pressure outlets, e) and control means for operating said solenoid means to independently reciprocate said pulse valves thereby repeatedly connecting said pressurized fluid pulse passing outlets and said exhaust fluid outlets to the actuator body to controllably apply fluid pressure to opposite sides of the piston, for controlled time intervals and at controlled frequencies, to accurately control movement of the piston and valve spool.

* * * * *